US005827125A

United States Patent [19]

Lee

[11] Patent Number: 5,827,125

[45] Date of Patent: Oct. 27, 1998

[54] GOLF PUTTING PRACTICE DEVICE

[76] Inventor: Do W. Lee, 1808 Daeyeon-Dong, Daeyeonsamikbeach Apt. 105-1103, Nam-Ku, Pusan, Rep. of Korea

[21] Appl. No.: 852,863

[22] Filed: May 7, 1997

[30] Foreign Application Priority Data

Dec. 31, 1996 [KR] Rep. of Korea ..... 1996-68699

[51] Int. Cl.[6] ..... A63B 69/36

[52] U.S. Cl. ..... 473/139; 473/145; 473/200; 434/252; 434/273

[58] Field of Search ..... 473/139, 145, 473/278, 279, 190, 200, 273; 435/252

[56] References Cited

U.S. PATENT DOCUMENTS 2,656,720 10/1953 Sonnett ..... 473/145
2,879,996 3/1959 Lederer ..... 473/279
4,384,718 5/1983 Cachola .
4,563,010 1/1986 McDorman et al. .
4,871,175 10/1989 Levin et al. .
5,180,168 1/1993 Balestrieri .
5,464,220 11/1995 Hansen et al. .
5,584,768 12/1996 Lee .

*Primary Examiner*—George J. Marlo
*Attorney, Agent, or Firm*—Birch, Stewart, Kolasch & Birch, LLP

[57] ABSTRACT

A golf putting practice device comprising a stroke panel and a stance panel, said stance panel adjustably connected to said stroke panel so that said panels are spaced apart in a predetermined relationship, a ball-bell resiliently mounted on the stroke panel and an aperture provided in said stroke panel, in front of said ball-bell, whereby when the ball-bell is struck by a putting stroke it is pushed into the aperture thereby not interfering with the follow-through of the putting stroke.

10 Claims, 2 Drawing Sheets

GOLF PUTTING PRACTICE DEVICE

BACKGROUND OF THE INVENTION

1. Field of the Invention

The present invention relates to a golf putting practice device for training to putt a golf ball more accurately, and more particularly, to a device for improving the putting stance and the putting stroke while putting a golf ball.

2. Description of the Related Art

Various types of golf putting practice devices for training and practicing the putting stroke are well known in the art. Generally, by maintaining a consistent putting stance, it has been found that the accuracy of a golfer's putt can be substantially improved.

Typically, the ideal stance for a golfer is the stance which is not comfortable to the golfer. Therefore, an ideal stance may vary from one golfer to the next, with some golfers preferring a more open stance, while others prefer a more closed stance. The stance may also vary as a consequence of different golfer heights and shoulder widths. Such conventional golf putting or swing practice devices for improving a golfer's stance are disclosed in U.S. Pat. No. 4,384,718, U.S. Pat. No. 4,563,010, U.S. Pat. No. 4,871,175, U.S. Pat. No. 5,464,220, and U.S. Pat. No. 5,180,168.

However, such conventional golf swing and putting practice devices suffer from a number of problems, such as, for example, it is difficult for a golfer,trainee to maintain an ideal golf stance, it is impossible for a golfer, trainee to strike a golf ball consistently with the same stroke, and it is difficult for a golfer, trainee to practice the golf stance and to practice the pendulum stroke at the same time. Also, since such conventional golf practice devices have a complicated structure, making these devices is very expensive to manufacture.

SUMMARY OF THE INVENTION

Therefore, it is an object of the present invention to provide an improved golf putting practice device which eliminates the above problems encountered with conventional golf putting practice devices.

Another object of the present invention is to provide a golf putting practice device which includes a stroke panel having a receiving groove disposed on the center bottom thereof, a target line and a metronome disposed thereon, and a stance panel having an insert plate which extends from the center portion thereof for adjustably and selectively assembling the stance panel within the receiving groove of the stroke panel, whereby the golf putting practice device can be effectively adjusted to accommodate a variety of putting stances.

A further object of the present invention is to provide a golf putting practice device which is simple in structure, inexpensive to manufacture,durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a golf putting practice device which includes a stroke panel adjustably assembled with a stance panel, and a metronome disposed on an exterior surface of the stroke panel and a bell having a resilient support, disposed on a target line of the stroke panel, whereby when a golfer, trainee hits the bell repeatedly, the golfer, trainee may improve his putting stance and putting stroke, and may rapidly improve his or her putting proficiency.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
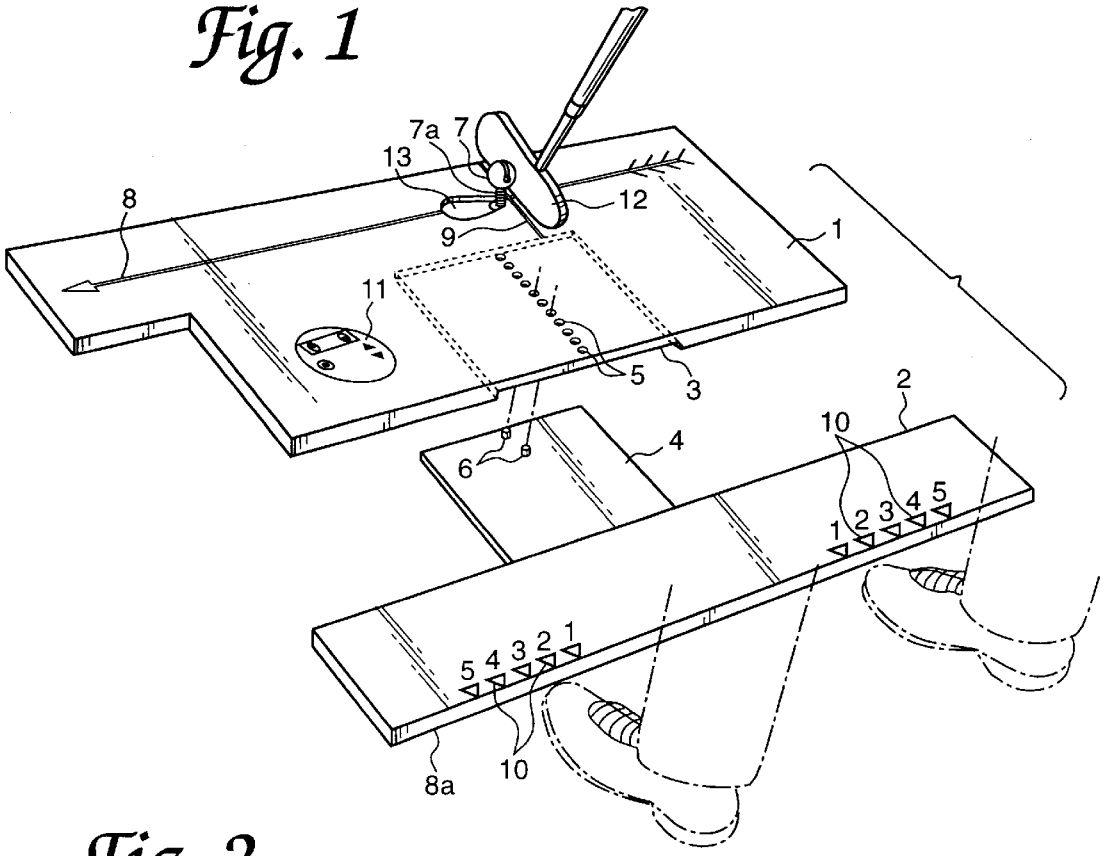
FIG. 1 is an exploded perspective view of a golf putting practice device according to the present invention in an unassembled state.

Referring now in detail to the drawings for the purpose of illustrating preferred embodiments of the present invention, the golf putting practice device as shown in FIGS. 1, 2, 3, and 4, comprises a stroke panel 1 having a receiving groove 3 disposed in the central portion thereof, and a stance panel 2 having an insert plate 4, which can be slidably and adjustably assembled within the receiving groove 3 of the stroke panel 1. The stroke panel and stance panel 1 and 2 can be made of plastic, wood, or the like, and are both disposed in parallel to each other.

As shown in FIGS. 1, 3, 5, 6, and 7, the stroke panel 1 further includes a metronome disposed on an exterior surface thereof for improving the timing of the pendulum stroke, a longitudinal target line 8 disposed on the exterior surface thereof and in parallel with the stance panel 2, a ball bell 7 mounted on a resilient support 7*a* positioned along the target line and an aperture provided in the stroke panel disposed in front of the ball bell. The receiving groove 3 has a plurality of holes 5 disposed perpendicular to the target line. At address, the putter 12 is placed on a putter line 9 which is disposed at a right angle to the target line 8.

Figure 5:
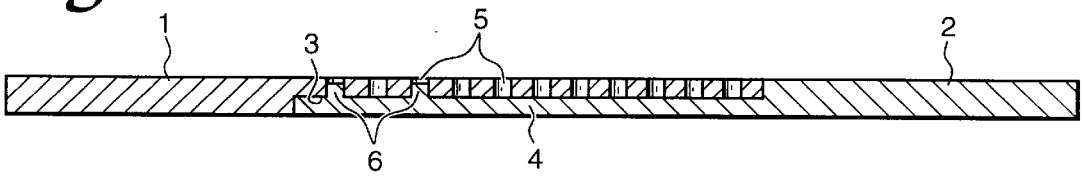
FIG. 5 is a cross-sectional view of FIG. 4.

As shown in FIGS. 1 and 5, the stance panel 2 further includes a pair of pins 6 for selectively locking the stance panel in the desired apertures 5 provided in the receiving groove 3 of the stroke panel 2. When the strike panel and stance panel are assembled, a stance line 8*a* is defined at the edge of the stance panel. A plurality of stance space points 10 for both feet of the golfer. A plurality of stance space points 10 are provided for both feet of the golfer. The stance line 8*a* and the target line 7 are both disposed in parallel within the golf putting practice device in accordance with the present invention. The stance space points which define the width of the stance are preferably five in number.

Figure 6:
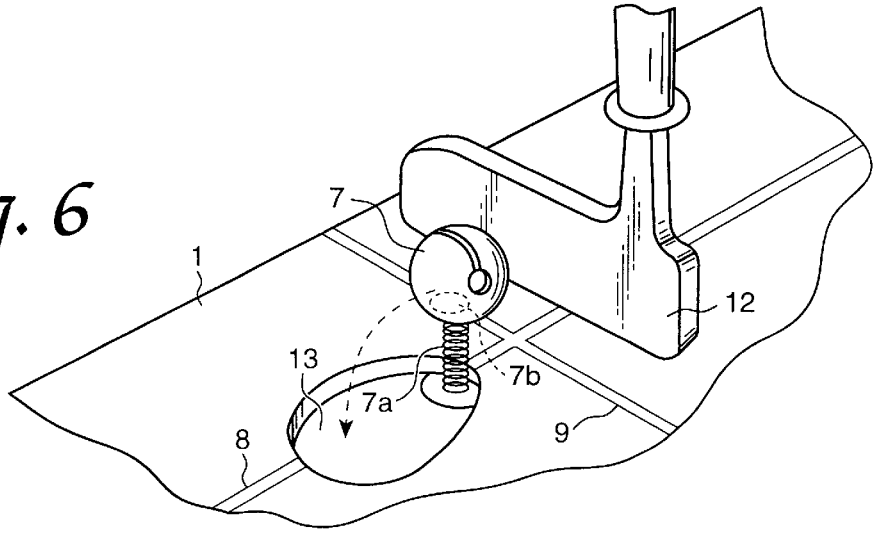
FIG. 6 is an enlarged perspective view of the putting portion of the golf putting practice device according to the present invention.

As shown in FIG. 6, the ball-bell 7 contains a slit disposed on the upper portion thereof for enhancing the ringing sound thereof, and a movable weight 7*b* is disposed within the ball which strikes the surface when the putter 12 hits the ball-bell 7. A bell connecting rod extends from the ball-bell for connecting with the resilient member 7*a* is disclosed in U.S. Pat. No. 5,584,768 entitled by the present inventor.

Figure 2:
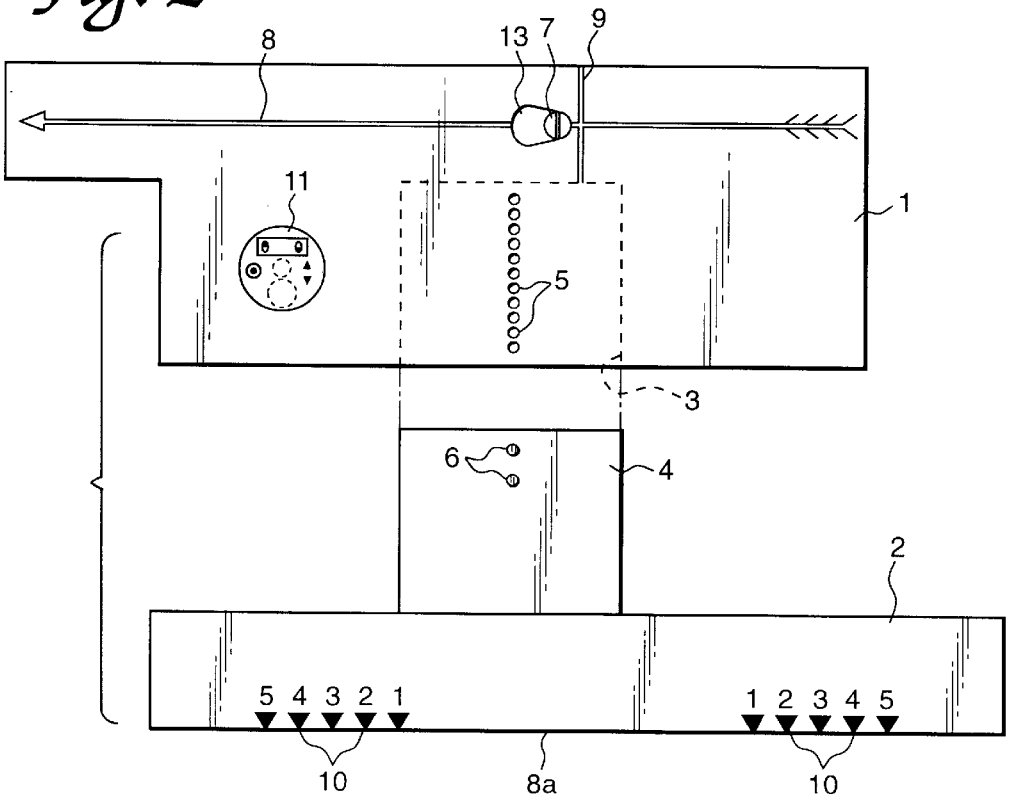
FIG. 2 is an exploded top plan view of the golf putting practice device according to the present invention.
Figure 3:
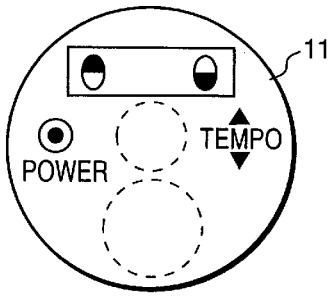
FIG. 3 is a top plan view of a metronome provided for the putting practice device according to the present invention.
Figure 4:
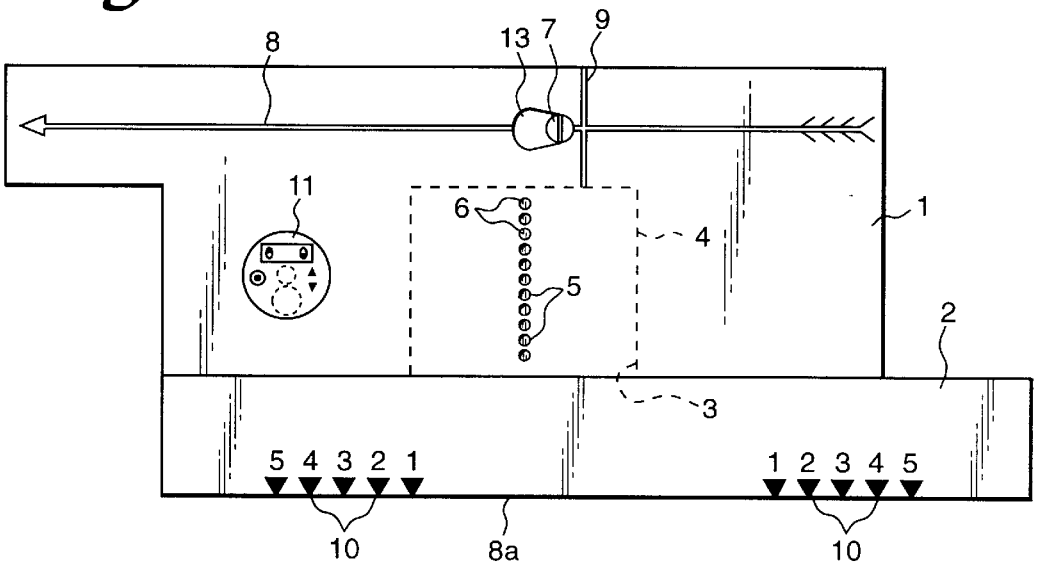
FIG. 4 is a top plan view of an assembled golf putting practice device according to the present invention.

As shown in FIGS. 2, 4, and 5, the golf putting practice device according to the present invention assembles and operates as follows. In assembling the device, the golfer, trainee, first of all, determines the distance between the bell 7 and both feet and adjusts the pins 6 in the apertures 5 of the receiving groove 3 to accommodate this distance. Therefore, the stroke panel 1 and the stance panel 2 are selectively adjusted relative to each other and tightly assembled together (FIGS. 4. and 5). With the stroke panel and stance panel in proper position, both eyes of the golfer should look over the bell 7.

Thereafter, both feet of the golfer are aligned along edge 8*a* and the distance between the feet is determined using the pair of stance space points 10. Generally speaking, the distance between one foot and the other foot is approximately the same as the width of the shoulders of the golfer, trainee. Generally, the golfer, trainee should have a comfortable putting stance.

Then, the golfer, trainee practices by striking the bell 7 with a putter 12. At this time, the putter 12 addresses the ball along the putter line 9 and the putter strikes the bell along the target line 8. Also, the golfer, trainee can use the cadence of the metronome 11 for improving the tempo of the putting stroke.

The golfer, trainee should practice with his shoulders in parallel with the target line 8, with the putter's face always a right angle to the target line 8, and with the putter 12 swinging along the target line 8.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf putting practice device comprising:

a stroke panel and a stance panel, said stance panel adjustably connected to said stroke panel so that said panels are spaced apart in a predetermined relationship, a ball-bell resiliently mounted on the stroke panel and an aperture provided in said stroke panel, in front of said ball-bell, whereby when the ball-bell is struck by a putting stroke the ball-bell makes a bell-like sound as it is pushed into the aperture, thereby not interfering with the follow-through of the putting stroke.

2. The golf putting practice device of claim 1 wherein said stroke panel contains a groove and the stance panel contains an insert plate which slidably fits within said groove.

3. The golf putting practice device of claim 2 wherein the stroke panel is provided with a target line, the groove contains a plurality of apertures extending in a direction away from the target line and the insert plate of the stance panel contains a number of pin members which are positioned to engage a corresponding number of aperture.

4. The golf putting practice device of claim 3 wherein the apertures are disposed perpendicular to the target line.

5. The golf putting practice device of claim 1 wherein a metronome is attached to the device.

6. The golf putting practice device of claim 3 wherein a putter line is disposed behind the resiliently mounted ball bell, simultaneously perpendicular to the target line.

7. The golf putting practice device of claim 1 wherein the edge of the stance panel defines a stance line which is substantially parallel to the target line.

8. The golf putting practice device of claim 1 wherein spaced-apart markings are provided on the stance panel for adjusting the spacing of the feet relative to each other and relative to the ball bell.

9. The golf putting practice device of claim 1 wherein the ball-bell contains a weight member disposed therein.

10. The golf putting practice device of claim 1 wherein the stroke panel and stance panel are made of plastic or wood.

* * * * *